US008408665B2

(12) United States Patent
Lim

(10) Patent No.: US 8,408,665 B2
(45) Date of Patent: Apr. 2, 2013

(54) REFRIGERATOR DOOR

(75) Inventor: Kiyoung Lim, Changwon (KR)

(73) Assignee: LG Electronics Inc., Seoul (KR)

( * ) Notice: Subject to any disclaimer, the term of this patent is extended or adjusted under 35 U.S.C. 154(b) by 252 days.

(21) Appl. No.: 12/812,536

(22) PCT Filed: Apr. 1, 2009

(86) PCT No.: PCT/KR2009/001668
§ 371 (c)(1),
(2), (4) Date: Jul. 12, 2010

(87) PCT Pub. No.: WO2009/145459
PCT Pub. Date: Dec. 3, 2009

(65) Prior Publication Data

US 2010/0287975 A1 Nov. 18, 2010

(30) Foreign Application Priority Data

Apr. 2, 2008 (KR) ..... 10-2008-0030600

(51) Int. Cl.
*A47B 96/04* (2006.01)
*A47B 17/04* (2006.01)
*A47B 97/00* (2006.01)

(52) U.S. Cl. ..... 312/405; 312/204

(58) Field of Classification Search ..... 312/204, 312/405, 405.1, 265.5, 265.6, 292
See application file for complete search history.

(56) References Cited

U.S. PATENT DOCUMENTS 4,046,438 A * 9/1977 Benasutti et al. ..... 312/139.2
5,048,233 A * 9/1991 Gidseg et al. ..... 49/501
5,358,326 A * 10/1994 Cherry et al. ..... 312/405
6,055,823 A * 5/2000 Baker et al. ..... 62/265
2003/0132690 A1* 7/2003 Shin et al. ..... 312/405
2004/0148958 A1* 8/2004 Park ..... 62/381
2004/0178710 A1* 9/2004 Kim et al. ..... 312/405
2004/0183413 A1* 9/2004 Koo ..... 312/401
2008/0143227 A1* 6/2008 Kim et al. ..... 312/405

FOREIGN PATENT DOCUMENTS

DE 102005057161 * 5/2007
KR 10-2006-0119470 A 11/2006
KR 10-2006-0128422 A 12/2006

(Continued)

OTHER PUBLICATIONS

KR 100722842 machine translation.*

(Continued)

*Primary Examiner* — Janet M Wilkens
*Assistant Examiner* — Andrew Roersma
(74) *Attorney, Agent, or Firm* — Birch, Stewart, Kolasch & Birch, LLP

(57) ABSTRACT

A refrigerator door is provided. The refrigerator includes a door body filled with an insulating material, an exterior member on a front surface of the door body, a home bar frame around an opening opened in a side of the door body, a home bar cover coupled to the home bar frame to support at least one end of the exterior member, and a home bar door pivotally coupled to the home bar frame to selectively shield the opening. The home bar door shields an exposed portion of the home bar cover when the home bar door is closed. Thus, an outer appearance of a front surface of the refrigerator is improved nearly to unity.

14 Claims, 2 Drawing Sheets

FOREIGN PATENT DOCUMENTS

| | | | | |
|---|---|---|---|---|
| KR | 10-2007-0003397 | A | | 1/2007 |
| KR | 100678674 | | * | 2/2007 |
| KR | 10-0722842 | B1 | | 5/2007 |
| KR | 20070070066 | | * | 7/2007 |
| KR | 20070076990 | | * | 7/2007 |
| KR | 100766057 | | * | 10/2007 |
| WO | WO 2007/078149 | A1 | | 7/2007 |

OTHER PUBLICATIONS

KR 1020070070066 machine translation.*
KR 1020060119470 machine translation.*

* cited by examiner

REFRIGERATOR DOOR

TECHNICAL FIELD

The present disclosure relates to a refrigerator door.

BACKGROUND ART

Generally, refrigerators are home appliances that can store foods at a low temperature in a storage space shielded by a refrigerator door. The storage space is cooled using cool air generated through heat exchange with refrigerant circulating a refrigeration cycle to maintain the stored foods in an optimum state.

With changes in dietary life and the tendency toward luxurious products, such a refrigerator increases steadily in size, and their functions becomes more varied. Thus, the refrigerator having various structures with consideration of user's convenience and including convenient devices such as a home bar and dispenser is being introduced in the market.

Recently, since a design as well as functions of the refrigerator affect important factors of their purchase decision, the refrigerator having various colors and textures is being developed.

Typically, a body of the refrigerator or a front surface of a refrigerator door is formed of a VCM steel sheet on which various colors and patterns are printed, or the whole or a portion of an outer appearance of the refrigerator is formed of a tempered glass in order to give a really deluxe feeling as well as express the various colors and textures, and thereby to improve an entire design of the refrigerator and realize an elegant exterior.

However, when the outer appearance is formed of the tempered glass, a home bar frame for supporting the tempered glass is further provided in the refrigerator including the home bar as the convenient devices.

The home bar frame is formed of a material different from the tempered glass, i.e., a plastic injection material, and protrudes from the front surface of the refrigerator door. Thus, an outer appearance of the front surface of the refrigerator door is not uniform.

DISCLOSURE OF INVENTION

Technical Problem

Embodiments provide a refrigerator door in which a home bar cover supporting an exterior member defining an outer appearance of a front surface of a door is shield by a home bar door to prevent the home bar cover from being exposed to the outside, and components constituting the outer appearance of the front surface of the door is formed of the same material to improve the outer appearance of the door.

Embodiments also provide a refrigerator door in which an upper exterior member is disposed above a home bar door, a lower exterior member is disposed under the home bar door, a middle exterior member is disposed on a side in which a door handle is disposed, and a home bar exterior member is in contact with an end of the middle exterior member and an end of the door body to define the whole outer appearance of the door by the exterior members.

Embodiments also provide a refrigerator in which exterior members are disposed at upper and lower portions of a home bar and a side corresponding to a door handle, and the whole outer appearance of a front surface of a door is defined by the exterior members and a home bar door in contact with an end of the door.

Technical Solution

In one embodiment, a refrigerator door includes: a door body filled with an insulating material; an exterior member on a front surface of the door body; a home bar frame around an opening opened in a side of the door body; a home bar cover coupled to the home bar frame to support at least one end of the exterior member; and a home bar door pivotally coupled to the home bar frame to selectively shield the opening, wherein the home bar door shields an exposed portion of the home bar cover when the home bar door is closed.

In another embodiment, a refrigerator door includes: a door body through which an opening having a rectangular shape passes; a home bar door selectively shielding the opening; a door handle vertically disposed on a side of the door body; and an exterior member on a front surface of the door body, the exterior member defining an outer appearance of the door body, wherein the exterior member includes: an upper exterior member over the home bar door; a lower exterior member under the home bar door; a middle exterior member between the upper exterior member and the lower exterior member, the middle exterior member being in contact with an end portion of the door body and an end portion of the home bar door at a side corresponding to the door handle; and a home bar exterior member on a front surface of the home bar door, the home bar exterior member being in contact with end portions of the upper exterior member, the lower exterior member, the middle exterior member, and the door body.

In further another embodiment, a refrigerator includes: a body providing a storage space; a door coupled to the body to selectively shield the storage space; a door handle spaced from a front surface of the door, the door handle being grasped by a user; a home bar door selectively shielding an opening passing through the door; an exterior member on an upper side and a lower side of the home bar door and a lateral side of the home bar door corresponding to the door handle, the exterior member defining an outer appearance of the door; and a home bar exterior member on a front surface of the home bar door, the home bar exterior member being formed of the same as the exterior member and in contact with an end portion of the exterior member and a lateral end of the door when the home bar door is closed.

Advantageous Effects

According to the embodiments, since the home bar cover supporting the exterior member is disposed in a rear direction of the home bar door, the home bar cover is not exposed to the outside when the home bar door is closed.

Thus, in a case where the front surface of the home bar door is formed of the same material as the exterior member, the front surface of the door is formed of the same material to realize a quality and elegant exterior of the door.

Therefore, satisfaction of products increases to enhance the company image.

MODE FOR THE INVENTION

Hereinafter, specific embodiments of the present disclosure will be described with reference to the accompanying drawings. However, the spirit of the invention is not limited to the embodiments. Other retrograde inventions by adding, changing or deleting other components or other embodiments within the scope of the invention may be easily proposed.

A refrigerator door may applied to all types of refrigerators formed of a tempered glass or a colored steel sheet for their out appearance and including a home bar. For further explanation and better comprehension, a side by side type refrigerator will now be described as an example.

Figure 1:
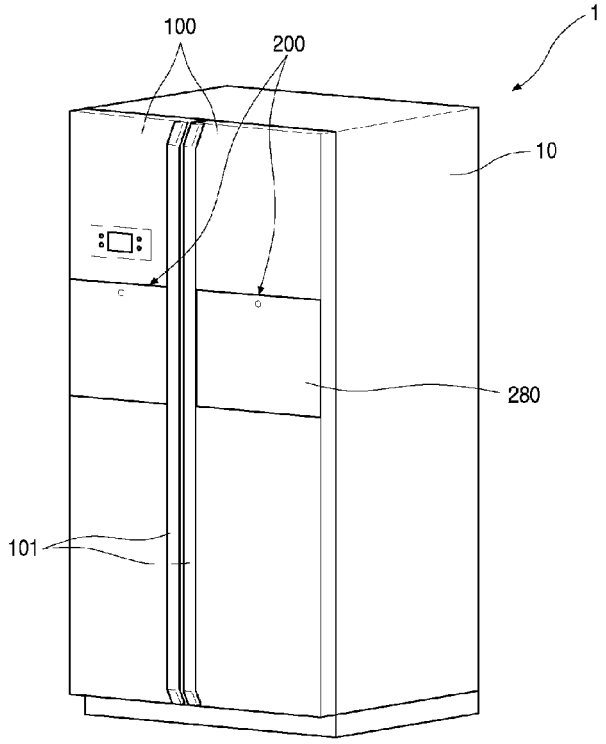
FIG. 1 is a perspective view of a refrigerator according to an embodiment.

FIG. 1 is a perspective view of a refrigerator according to an embodiment.

Referring to FIG. 1, a refrigerator 1 has an approximately rectangular parallelepiped shape in overall outer appearance. The outer appearance of the refrigerator 1 is defined by a body 10 and a door 100. The inside of the body 10 is partitioned to provide at least one or more storage spaces. The door 100 shields the storage spaces.

The body 10 has a rectangular parallelepiped shape having an opened front surface. The storage spaces for receiving foods are provided inside the body 10. The storage spaces are partitioned into left and right sides to define a refrigerating compartment and a freezing compartment. Each of the storage spaces is selectively shielded by the door 100.

The door 100 is hinge-coupled to the body 10 to pivot in left and right sides. The refrigerating compartment and the freezing compartment are selectively shielded due to the pivot movement of the door 100. The door 100 confines cool air of the storage spaces in a state where the door 100 is closed, and also, the door 100 defines the outer appearance of a front surface of the refrigerator 1. Detailed configurations with respect to the door 100 will now be described in detail.

A door handle 101 to be grasped for pivoting the door 100 by a user is provided on the front surface of the door 100. A home bar 200 is provided in at least one of the refrigerating compartment and the freezing compartment 100.

The frequently coming and going foods such as water or drinking water stored in the storage space of the body 10 are inserted or withdrawn the home bar 200 without opening the door 100. The home bar is openably and closably coupled to the door 100.

In detail, the foods received in the storage space within the body 10 or the storage space provided in a back surface of the door 100 are inserted or withdrawn by opening a home bar door 280 that will be described later.

The home bar 200 is generally disposed in the door 100 shielding the refrigerating compartment. However, the home bar 200 may be disposed in the door 100 shielding the freezing compartment in a case where a dispenser (not shown) is not provided. Alternatively, the home bar 200 may be disposed in both doors 100 as illustrated in FIG. 1.

Hereinafter, a configuration of the refrigerator door according to the present disclosure will be described in detail. For further explanation and better comprehension, the home bar provided in the refrigerating compartment will be described as an example.

Figure 2:
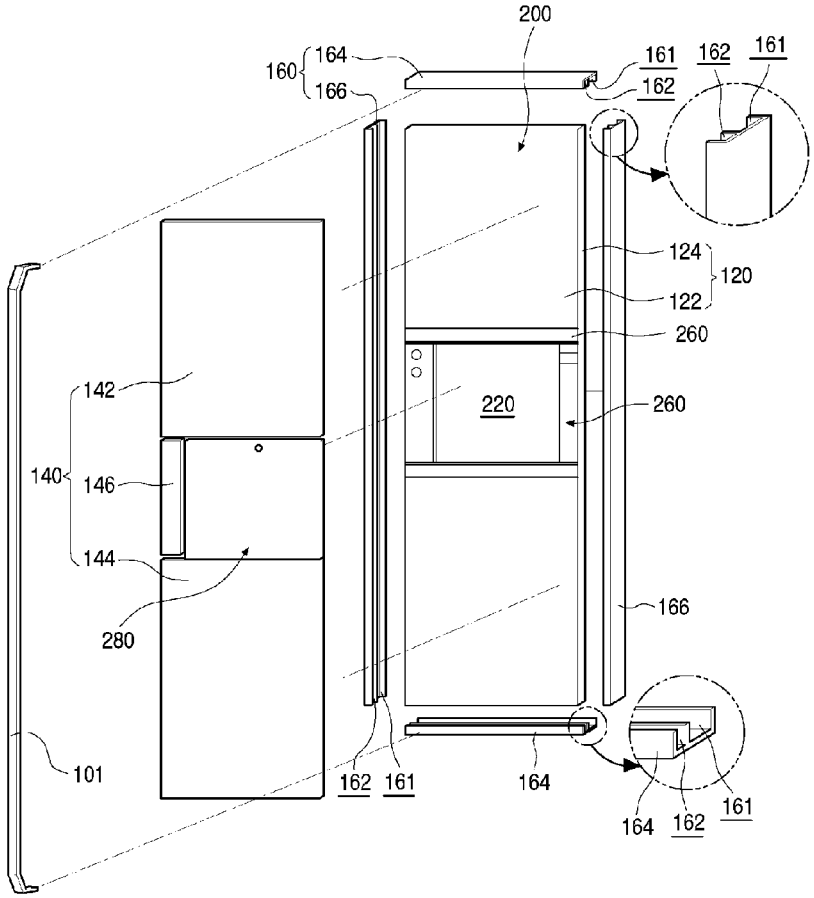
FIG. 2 is an exploded perspective view of a refrigerator door according to an embodiment.

FIG. 2 is an exploded perspective view of a refrigerator door according to an embodiment.

Referring to FIG. 2, the door 100 has an approximately rectangular parallelepiped shape having a height corresponding to that of the refrigerator 1 and a predetermined thickness. An overall outer appearance of the door is defined by coupling of a door body 120, exterior members 140, and a deco member 160 for fixing the door body 120 and the exterior members 140. The home bar 200 is disposed in an approximately central portion of the door 100.

The door body 120 includes an outdoor panel 122 and a door liner 124. An iron plate having a rectangular shape is bent at a predetermined length to fabricate the outdoor panel 122. The door liner 124 is coupled to a rear side of the outdoor panel 122. A foaming liquid including an expandable polystyrene material that is an insulating material is filled into a space between the outdoor panel 122 and the door liner 124.

The door liner 124 defines a back surface of the door 100. In general, an acrylonitrile butadiene styrene copolymer is injection-molded to fabricate the door liner 124. A formation end (not shown) for installing a receiving member (not shown) for receiving the foods is further provided in the door liner 124.

The exterior members 140 are disposed on a front surface of the door body 120. Each of the exterior members 140 is formed of a tempered glass or a plastic material. Various patterns and colors are added to realize an elegant outer appearance of the door 100.

The exterior members 140 include an upper exterior member 142, a lower exterior member 144, and a meddle exterior member 146. The upper exterior member 142 is disposed at an upper side of the home bar 200. The lower exterior member 144 is disposed at a lower side of the home bar 200. The middle exterior member 146 is disposed at a lateral side of the home bar 200.

The exterior members 140 are fixed by the deco member 160 coupled to a circumference of the door body 120 in a state where one ends of the exterior member 140 are supported by support potions 264 of a home bar cover 260 that will be described later.

The deco member 160 includes deco caps 164 disposed on upper/lower ends of the door body 120 and side decos 166 disposed on left/right ends of the door body 120. The deco caps 164 and the side decos 166 are coupled to the door body 120 using a coupling member such as a screw.

Door receiving parts 161 and exterior member receiving parts 162 are disposed inside the cap decos 164 and the side decos 166.

Each of the door receiving parts 161 provides a space having a width corresponding to a thickness of the door 100 to insert an end portion of a circumference of the door 100 therein. The door receiving parts 161 are disposed along length directions of the cap decos 164 and the side decos 166. Thus, the cap decos 164 and the side decos 166 may be installed on a circumference surface of the door 100.

Each of the exterior member receiving parts 162 provides a space having a width corresponding to a thickness of the exterior member 140 to insert an end portion of the exterior member 140 in a front direction of the door receiving part 161. The exterior member receiving parts 162 are disposed along the length directions of the cap decos 164 and the side decos 166. Thus, the exterior member 140 is fixedly installed on the front surface of the door 100 by the cap decos 164 and the side decos 166.

In detail, an upper end and both side ends of the upper exterior member 142, a lower end and both side ends of the lower exterior member 144, and a side end of the middle exterior member 146 are inserted into the exterior member receiving parts, and thus, fixed to the front surface of the door body 120.

Upper and lower ends of the door handle 101 are fixed to the cap decos 164 disposed on the upper and lower ends of the door 100, respectively. The door handle 101 may be spaced from the front surface of the door 100 in a front direction, and is configured to be easily grasped by the user.

An opening 220 is defined in an approximately central portion of the door body 120.

The opening 220 serves as a passage through which the foods stored in the storage space of the body 10 or the back surface of the door 100 are inserted or withdrawn through the home bar 200. The opening has an approximately rectangular shape and passes through the door body 120.

Figure 3:
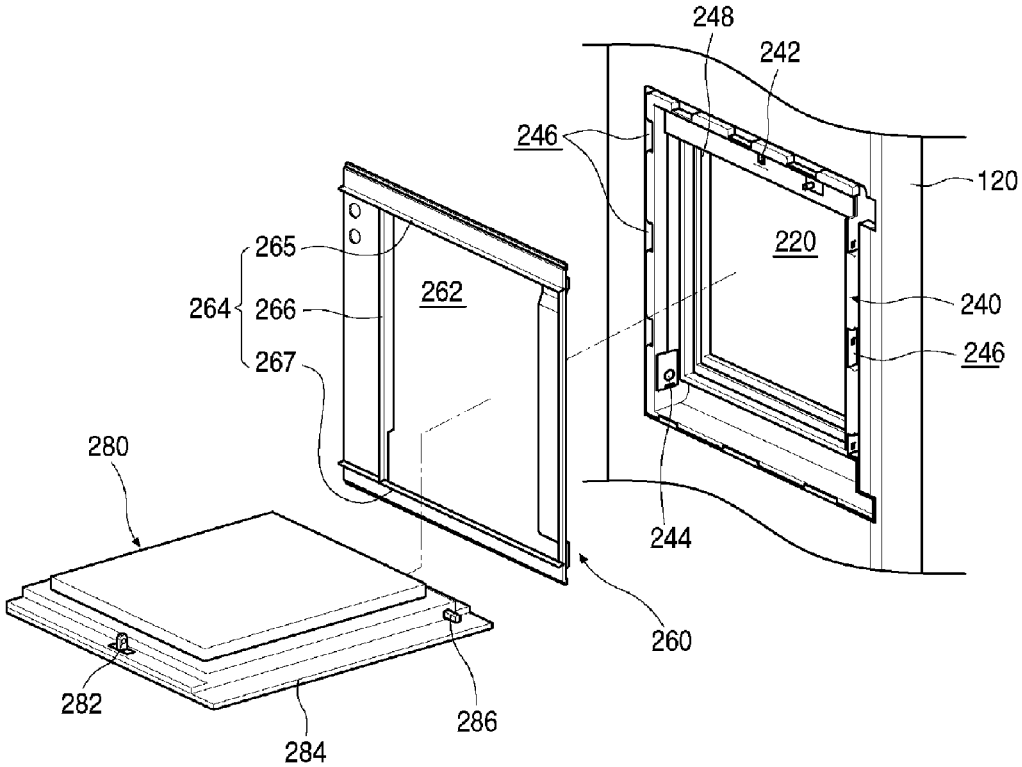
FIG. 3 is an exploded perspective view of a home bar according to an embodiment.
Figure 4:
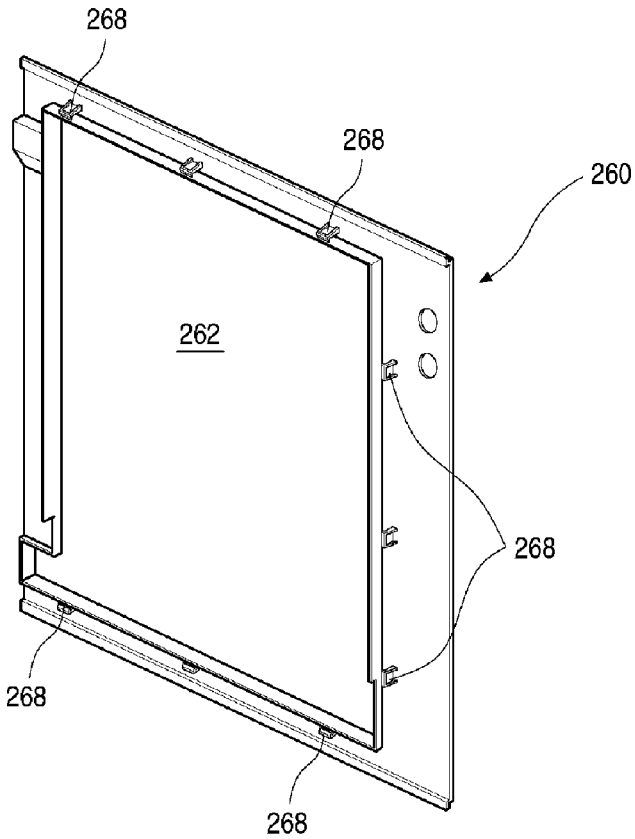
FIG. 4 is a perspective view illustrating a back surface of a home bar cover according to an embodiment.

FIG. 3 is an exploded perspective view of a home bar according to an embodiment, and FIG. 4 is a perspective view illustrating a back surface of a home bar cover according to an embodiment.

Referring to FIGS. 3 and 4, the home bar 200 is disposed in the approximately central portion of the door 100. The home bar 200 includes a home bar frame 240, the home bar cover 260, and the home bar door 280. The foods stored in the storage space can be withdrawn through the home bar 200 without opening the door 100.

The home bar frame 240 is injection-molded in a shape corresponding to that of the opening 220. The home bar frame 240 is installed on the opening 220 to finish the opening 220. A portion of a rear side of the home bar frame 240 is buried into the insulating material and fixed to a circumference of the opening 220.

The home bar frame 240 is closely attached to the home bar door 280 for opening and closing the opening 220 to prevent cool air within the body 10 from leaking. For this, the home bar frame 240 has a height difference stepped in an inside direction of the opening 220. Here, the opening 220 becomes narrow in the inside direction thereof.

A gasket 248 may be disposed inside the home bar frame 240 having the height difference. The gasket 248 is disposed along an inner circumference of the home bar frame 240. The gasket 248 is closely attached to the home bar door 280 to prevent the cool air from leaking to the outside when the home bar door 280 is closed.

A latch hole inserted into a door latch 282 of the home bar door 280 is defined in an upper central portion of the home bar frame 240. A front surface of the latch hole is opened to insert the door latch 282 of the home bar door 280 therein. When the door latch 282 is inserted, the latch hole 242 restricts the door latch 282 to prevent the home bar door 280 from being voluntarily opened.

Damping hinges 244 are further provided on lower ends of both sides of the home bar frame 240. The damping hinges 244 diminishes a rotation force of the home bar door 280 to reduce a pivot speed. It is affected by being coupled to a hinge 286 of the home bar door 280.

A protrusion recess 246 to which a hook protrusion 268, that will be described later, of the home bar cover 260 is coupled in a hooking manner is recessed at a position spaced by a previously set distance toward the inside of the circumference of the front surface of the home bar frame 240. The protrusion recess 246 is spaced a predetermined distance along the circumference of the home bar frame 240 and provided in plurality.

The protrusion recess 246 is coupled to the home bar cover 260. That is, the hook protrusion 268 protrudes from the home bar cover 260 at a position corresponding to that of the protrusion recess 246. Since the hook protrusion 268 is coupled to the protrusion recess 246 in the hooking manner, the home bar cover 260 is fixed to the home bar frame 240.

A central portion of the home bar cover 260 that corresponds to the outside of the latch hole 242 and the damping hinge 244 is punched to define a punch portion 262. The home bar cover 260 has the same width as that (left and right lengths) of the door body 120. That is, both side ends of the home bar cover 260 agrees with both side ends of the door body 120.

The support potions 264 for supporting one end of the exterior member 140 protrude from a circumference of the punch portion 262 of the front surface of the home bar cover 260. The support potions 264 are disposed at positions spaced inwardly by a previously set distance except at least one circumference of the home bar cover 260.

That is, the support potions 264 are not disposed on a side circumference (left circumference when viewed in FIG. 3) of the home bar cover 260 on which the door handle 101 is not provided. This is done because the one end of the exterior member 140 is not supported to the left side (when viewed in FIG. 3) circumference of the home bar cover 260, and the left side circumference of the home bar cover 260 is selectively shielded by the home bar door 280 that will be described later.

The support potions 264 include an upper support potion 265 supporting a lower end of the upper exterior member 142, a middle support potion 266 supporting side ends of the middle exterior member 146, and a lower support potion 267 supporting an upper end of the lower exterior member 144.

The upper support potion 265 and the lower support potion 267 have lengths corresponding to the left and right lengths (when viewed in FIG. 3) of the home bar cover 260, respectively. The middle support potion 266 has a length corresponding to a distance between the upper support potion 265 and the lower support potion 267. Each of the support potions 264 protrudes to have a height corresponding to a thickness of the exterior member 140 or a height less than the thickness of the exterior member 140. When the exterior member 140 is installed, the support potions 264 protrude to the outside of the exterior member 140, and also are not exposed to the outside.

The home bar frame 240 and the home bar cover 260 may be integrated in one body as necessary and coupled to the door body 120. Of course, since the components are integrated in one body, the components have the same as each other, and the plurality of support potions is disposed on the home bar frame 240.

The home bar door 280 is pivotally disposed on the front surface of the home bar cover 260. The home bar door 280 is hinge-coupled to the damping hinge 244 to selectively shield the opening 220.

The home bar door 280 has a height difference on a circumference of a back surface thereof. The height difference has a shape corresponding to that of the height difference formed inside the home bar frame 240. The insulating material is foam-filled into the circumference of the back surface of the home bar door 280 to prevent the cool air within the body 10 from being heat-exchanged with external air.

The door latch 282 is further disposed on an upper end of the back surface of the home bar door 280, i.e., at a position corresponding to that of the latch hole 242. The door latch 282 selectively interferes with the latch hole 242 to prevent the home bar door 280 from being voluntarily opened. That is, when the upper end of the home bar door 280 is pushed in a state where the home bar door is closed, the interference between the door latch 282 and the latch hole 242 is released to open the home bar door 280.

A home bar exterior member 284 formed of the same material as that of the exterior member 140 is further disposed on the front surface of the home bar door 280. When the home bar door 280 is closed, the front surface of the home bar door 280 has a plane having the same height as the exterior member 140.

Thus, when the home bar door is closed, the home bar cover 260 is not exposed.

Since the home bar door 280 is formed of the same material as that of the exterior member 140, the front surface of the door 100 is entirely formed of a homogeneous material to realize an elegant outer appearance of the door 100.

Hereinafter, a process of assembling the refrigerator door including the above-described components according to the present disclosure will be described.

For assembling the door 100 of the refrigerator 1, the outdoor panel 122 is first coupled to the door liner 124, and the inside thereof is foam-filled with the insulating material to fabricate the door body 120. The home bar frame is installed on the opening 220 defined in the door body 120. The home bar cover 260 is fixedly installed on the home bar frame 240.

The home bar cover 260 has a horizontal length corresponding to the width of the door 100. Thus, the door body 120 is divided into upper and lower portions with respect to the home bar cover 260. Next, the home bar door 100 is pivotally coupled to the home bar frame 240 to complete the assembly of the home bar 200.

After the home bar cover 260 is installed, the exterior members 140 may be installed. The upper exterior member 142 of the exterior members 140 is disposed on an upper side of the home bar cover 260. The lower end of the upper exterior member 142 is supported by the upper support potion 265 of the home bar cover 260.

The lower exterior member 144 is disposed on a lower side of the home bar cover 260. The upper end of the lower exterior member 144 is in contact with the lower support potion 267 of the home bar cover 260. Also, the middle exterior member 146 is disposed between the upper exterior member 142 and the lower exterior member 144. The left end of the middle exterior member 146 is in contact with the middle support potion 266 of the home bar cover 260.

Since the cap deco 164 and the side deco 165 are installed, the exterior members 140 may be fixedly installed on the door 100.

In detail, the upper end of the upper exterior member 142 is fixed by the cap deco 164, and the both left and right ends thereof are fixed by the side deco 165. Here, since the lower end of the upper exterior member 142 is supported by the upper support potion 265, the upper exterior member 142 is fixedly installed on the upper portion of the front surface of the door 100.

The lower end of the lower exterior member 144 is fixed by the cap deco 164, and the both left and right ends thereof are fixed by the side deco 165. At this time, the upper end of the lower exterior member 144 is closely attached to the lower support potion 267 to fixedly install the lower exterior member 144 on the lower portion of the front surface of the door 100.

Also, the right end of the middle exterior member 146 is fixed by the side deco 165, and the left end thereof is in contact with the middle support potion 266. The upper and lower ends of the middle exterior member 146 are in contact with a lower surface of the upper support potion 265 and an upper surface of the lower support potion 267, respectively. Thus, the middle exterior member 146 is fixedly installed on the home bar cover 260.

The home bar exterior member 284 is further disposed on the front surface of the home bar door 100. When the home bar door 100 is closed, the upper and lower ends of the home bar exterior member 284 are in contact with the upper support potion 265 and the lower support potion 267 of the home bar cover 260, respectively. Also, the left end of the home bar exterior member 284 is in contacts with the middle support potion 266. The right end of the home bar exterior member 284 extends up to the right end of the door body 120 or a position in contact with the side deco 165.

Thus, the whole outer appearance of the door 100 is defined by the upper exterior member 142, the lower exterior member 144, the middle exterior member 146, and the home bar exterior member 284. The exterior members 140 are stably fixed by the home bar frame 240. Therefore, a portion of the home bar frame 240 in contact with the exterior members 140 can be not nearly exposed to the outside, thereby improving unity of the outer appearance.

Industrial Applicability

According to the embodiments, the whole outer appearance of the refrigerator door including the home bar are formed of the same material. Also, the components of the home bar cover for supporting the exterior members are not exposed to the outside. Therefore, the whole outer appearance of the refrigerator door can be improved, and thus, it may be expected to arouse customer's purchasing needs, thereby increasing industrial applicability.

The invention claimed is:

1. A refrigerator door comprising:

a door body having an access opening;

a plurality of exterior members mounted on a front surface of the door body defining an outer surface of the refrigerator door;

a home bar frame installed at the access opening;

a home bar cover coupled to the home bar frame and configured to support the plurality of exterior members;

a home bar door hingedly connected to the home bar frame and having a home bar exterior member; and a support portion forwardly protruded on the home bar cover supporting an edge of each exterior member of the plurality of exterior members and located between the edge of each of the exterior members and the home bar exterior member, wherein the home bar exterior member is formed of the same material as the plurality of exterior members, and wherein, when the home bar door is closed, the support portion is not exposed to the outside of the plurality of exterior members and the home bar exterior member.

2. The refrigerator door according to claim 1, wherein the support portion protrudes by a height corresponding to a thickness of the plurality of exterior members to support an end portion of each of the plurality of exterior members.

3. The refrigerator door according to claim 2, wherein the plurality of exterior members include:

an upper exterior member on an upper side of the home bar door, a lower end of the upper exterior member being supported by the support portion;

a lower exterior member on a lower side of the home bar door, an upper end of the lower exterior member being in contact with the support portion; and a middle exterior member on a lateral side of the home bar door between the upper exterior member and the lower exterior member, a lateral end of the middle exterior member being in contact with the support portion.

4. The refrigerator door according to claim 3, wherein the home bar exterior member is on a front surface of the home bar door, the home bar exterior member selectively shielding at least a portion of the home bar cover.

5. The refrigerator door according to claim 1, wherein the home bar cover has a horizontal length corresponding to a width defined by a distance between left and right sides of the door body.

6. The refrigerator door according to claim 1, wherein the exterior member are formed of one of tempered glass, plastic, and colored steel sheet materials.

7. The refrigerator door according to claim 1, wherein deco members for receiving ends of the plurality of exterior members to fix the exterior members are further disposed on upper and lower ends and left and right ends of the door body.

8. A refrigerator door comprising:

a door body through which an opening having a rectangular shape passes;

a home bar door selectively shielding the opening;

a door handle vertically disposed on a side of the door body;

an exterior member on a front surface of the door body, the exterior member defining an outer surface of the door body, the exterior member including:

an upper exterior member over the home bar door;

a lower exterior member under the home bar door;

a middle exterior member between the upper exterior member and the lower exterior member, the middle exterior member being in contact with an end portion of the door body and an end portion of the home bar door at a side corresponding to the door handle; and a home bar exterior member on a front surface of the home bar door, the home bar exterior member being in contact with end portions of the upper exterior member, the lower exterior member, the middle exterior member, and the door body, the home bar exterior member formed of the same material as the exterior members;

a home bar frame installed at the opening;

a home bar cover coupled to the front side of the home bar frame and configured to support the exterior members; and a support portion forwardly protruded on the home bar cover supporting an edge of each of the upper, lower and middle exterior members and located between the edge of each of the upper, lower and middle exterior members and the home bar exterior member, wherein, when the home bar door is closed, the support portion is not exposed to the outside of the upper, lower and middle exterior members and the home bar exterior member.

9. The refrigerator door according to claim 8, wherein cap decos for receiving and fixing the end portions of the upper exterior member, the lower exterior member, and the middle exterior member are disposed around the door body.

10. The refrigerator door according to claim 8, wherein the home bar frame is disposed around an inside of the opening, and support portions for supporting the end portions of the exterior members are disposed on a front surface of the home bar frame.

11. The refrigerator door according to claim 10, wherein the support portions comprise:

an upper support portion for supporting a lower end of the upper exterior member;

a lower support portion under the upper support portion, the lower support portion being in contact with an upper end of the lower exterior member; and a middle support portion connecting the upper support portion to the lower support portion, the middle support portion being in contact with a side end of the middle exterior member.

12. The refrigerator door according to claim 10, wherein the support portions protrude by a height less than that of a front surface of the exterior members when the exterior members are installed.

13. The refrigerator door according to claim 10, wherein the home bar cover has a width corresponding to a horizontal length of the door body.

14. The refrigerator door according to claim 8, wherein the home bar frame is disposed around an inside of the opening, and support portions for supporting end portions of the exterior members are further disposed on the home bar frame, the support portions protrude by a height less than a thicknesses of the exterior members.

* * * * *